US011913141B2

(12) United States Patent
Griesshammer et al.

(10) Patent No.: US 11,913,141 B2
(45) Date of Patent: Feb. 27, 2024

(54) DRAFTING SYSTEM FOR A TEXTILE MACHINE

(71) Applicant: Saurer Intelligent Technology AG, Arbon (CH)

(72) Inventors: Christian Griesshammer, Berlingen (CH); Ludek Malina, Kloten (CH)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 18/053,779

(22) Filed: Nov. 9, 2022

(65) Prior Publication Data

US 2023/0141021 A1 May 11, 2023

(30) Foreign Application Priority Data

Nov. 9, 2021 (CH) ..... 070528/2021

(51) Int. Cl.

| | |
|---|---|
| ***D01H 5/48*** | (2006.01) |
| ***D01H 4/02*** | (2006.01) |
| ***D01H 5/22*** | (2006.01) |
| ***D01H 5/46*** | (2006.01) |
| ***D01H 5/56*** | (2006.01) |

(52) U.S. Cl.

CPC ..... *D01H 5/46* (2013.01); *D01H 4/02* (2013.01); *D01H 5/22* (2013.01); *D01H 5/48* (2013.01); *D01H 5/565* (2013.01)

(58) Field of Classification Search

CPC ..... D01H 4/02; D01H 5/46–565

See application file for complete search history.

(56) References Cited

U.S. PATENT DOCUMENTS

| | | | | | |
|---|---|---|---|---|---|
| 2,811,751 | A | * | 11/1957 | Nebich | D01H 5/505 19/281 |
| 2,813,309 | A | * | 11/1957 | West | D01H 13/14 19/283 |
| 2,867,852 | A | * | 1/1959 | Dausch | D01H 5/50 19/267 |
| 2,944,301 | A | * | 7/1960 | Blalock | D01H 5/56 19/294 |
| 3,412,434 | A | | 11/1968 | Fusaroli | |
| 5,012,557 | A | * | 5/1991 | Stahlecker | D01H 5/56 19/271 |

(Continued)

FOREIGN PATENT DOCUMENTS

| | | | | |
|---|---|---|---|---|
| CH | 713498 A2 | * | 8/2018 | |
| DE | 102019131861 A1 | * | 5/2021 | D01H 5/525 |

(Continued)

*Primary Examiner* — Shaun R Hurley

(74) *Attorney, Agent, or Firm* — Fox Rothschild LLP

(57) ABSTRACT

In a drafting system (1) for a textile machine, in particular an air-spinning machine, for drafting a strand-shaped fibre band fed to the drafting system, having a plurality of roller pairs arranged in succession in a running direction (A) of the fibre band and each having a top roller (3) and a bottom roller (4), and a weighting device for applying a load to the top roller (3) of the plurality of roller pairs; wherein the respective bottom roller (4) is mounted and held in a housing (2) of the drafting system (1), wherein the respective top roller (3) is mounted and held in the housing (2) of the drafting system (1) by means of a top roller carrier (30) which can be pivoted about a rotary axis.

20 Claims, 3 Drawing Sheets

(56) References Cited

U.S. PATENT DOCUMENTS

| | | | | | |
|---|---|---|---|---|---|
| 5,035,027 | A * | 7/1991 | Grau | ..... | D01H 5/46<br>19/258 |
| 2019/0194834 | A1 * | 6/2019 | Haska | ..... | D01H 1/162 |

FOREIGN PATENT DOCUMENTS

| | | | | | |
|---|---|---|---|---|---|
| EP | 0488007 | A1 | 6/1992 | | |
| WO | WO-2015166323 | A1 * | 11/2015 | ..... | B65H 51/10 |
| WO | WO-2021090137 | A1 * | 5/2021 | ..... | D01H 5/46 |

* cited by examiner

DRAFTING SYSTEM FOR A TEXTILE MACHINE

This application claims priority to Swiss Patent Application No. 070528/2021 filed on Nov. 9, 2021. The content of the application is incorporated herein by reference in its entirety.

TECHNICAL AREA

The present invention relates to a drafting system for a textile machine, in particular an air-spinning machine, having a plurality of roller pairs arranged one after the other in a running direction of a fibre band and a weighting device for applying a load to the top roller of the plurality of roller pairs.

TECHNICAL BACKGROUND

Drafting systems for a textile machine have been known for a long time. They are used to draft a strand-shaped fibre band fed to the drafting system. In this process, fibres of a fibre band are pulled apart to form a finer band. The basic principle of drafting systems is based on drafting of the fibre band between at least two rotating machine parts or roller pairs running at different circumferential velocities.

While most of the fibre material is held in place by the first, slower roller pair, some of the fibre gets between the faster roller pair. This transports the fibres forward and thus a thinner fibre band is formed. The capacity of a drafting system consisting of two roller pairs is limited, which is why drafting systems consisting of several roller pairs and so-called aprons are used. The aprons increase the fibre guidance and restraining forces for the fibres. Such aprons were already described at the beginning of the 20th century by Fernando Casablancas.

CH683698 describes a drafting system for a fine spinning machine with at least three roller pairs having top and bottom rollers. The bottom rollers are configured for at least two drafting systems arranged next to one another with a common drive. The bottom rollers are fastened to a shaft at both ends and mounted in a housing for the two drafting systems. The top rollers are individually spring-mounted on a weighting arm, each in a rotatable carrier, and arranged laterally to the weighting arm. The rotatable carrier is mounted by means of bearing bushes on an L-shaped support part, which is attached to the weighting arm without play. Such a support and weighting arm therefore has top rollers for two drafting systems, which are arranged on both sides of the support and weighting arm. The problem with such a drafting system is that an uneven load on the top rollers leads to axially directed forces on the fibre band. Also, independent adjustment of the roller pairs for individual spinning positions is not possible. In addition, swinging out the top rollers individually is not possible.

Another variant of a drafting system for drafting a strand-shaped fibre band fed to the drafting system is disclosed in CH712605 and CH713498, this drafting system having at least two drafting system modules arranged one behind the other in a transport direction of the fibre band and having a bottom roller and a top roller. Each drafting system module has a separate carrier on which the top and bottom rollers are mounted. The top roller is mounted on a receptacle in such a way that it can be moved back and forth between a weighting position and a non-weighting position independently of the rollers of the other drafting system modules. In contrast to mounting all rollers on one support arm, which is only mounted on one side via a pivot joint, in this variant the top rollers are each mounted on their own support and weighting arm. The frictional connection between the top and bottom rollers can be individually adjusted. However, completely swinging out the top rollers individually is not possible. Another disadvantage is that the load on the roller is configured as one-sided, which can result in the axes of the top and bottom rollers not being parallel. If there is a change in the load, this error must be determined and, if necessary, corrected.

EP1431433 discloses a drafting system with three roller pairs, with provision for the top rollers to be lifted off the bottom rollers. At least one top roller can be lifted off independently of the remaining top rollers. For this purpose, the top rollers are attached to two support and weighting arms. The top rollers are each held in a guide of a top roller yoke and are spring-loaded. However, such a guide is subject to friction, which means that a reset after lifting the top roller due to thick places in the fibre band, out-of-roundness of the rollers or the like, functions too slowly or only poorly. In addition, the top roller is loaded on both sides with one spring each, which makes a precise and symmetrical force adjustment almost impossible.

Drafting systems have also been disclosed (DE102019115905 A1) in which the top rollers are held laterally by means of two arms. The disadvantage of such a variant is that the load on the top roller is applied via two weighting structures on both sides, making it difficult to set a load force precisely because both weighting structures have to be set exactly. In addition, lateral visibility and operability can be limited.

Drafting systems for air-spinning machines have very high operating speeds compared to other spinning machines, and must therefore be able to be individually stopped immediately in the event of a thread break in the spinning position, for example. It is therefore advantageous to drive the rollers individually and to be able immediately to open the stopped drafting system individually if required. Due to the high operating speeds, exact positioning of the rollers with low tolerances of, for example, a maximum of 2/10 mm is also advantageous. Such exact positioning of the rollers is impossible or hardly possible with drafting systems of prior art, or at most with a very large complexity of work.

Representation of the Present Invention

One problem addressed by the present invention is that of providing a drafting system for drafting a strand-shaped fibre band fed to the drafting system, which also meets the requirements for air-spinning machines and avoids the problems described above.

This problem is solved by means of a drafting system for a textile machine, in particular an air-spinning machine, having features disclosed herein. The drafting system for drafting a strand-shaped fibre band fed to the drafting system has a plurality of roller pairs arranged in succession in a running direction of the fibre band, each having a top roller and a bottom roller, and a weighting device for applying a load to the top roller of the plurality of roller pairs. The bottom roller is mounted and held in a housing of the drafting system. The top roller is mounted and held in the housing of the drafting system by means of a top roller carrier which can be pivoted about a rotary axis. The drafting system further has a pivotable weighting arm which can be brought into an open position and a closed position. The weighting arm has an individually adjustable weighting device for each roller pair, which applies a load to the respective pivotable top roller carrier in a weighting position when the weighting arm is closed.

Such a drafting system has several advantages over drafting systems of prior art.

The top roller is not trapped in a weighting arm, but pivots in the drafting system housing. Accordingly, the positioning of the bottom and top rollers is decoupled from the weighting device, i.e. it is independent of the positioning of the weighting device. The weighting arm is only used for applying a load to the roller pairs and not for positioning and supporting the top rollers. The position of the bottom and top rollers can thus be adjusted easily and independently of the load. This leads to lower tolerances in the exact positioning of the rollers relative to one another.

In addition, each top roller is individually loaded and its load can be adjusted individually and/or collectively. Partial load reduction is also possible, e.g. when the spinning position is at a standstill, so that the top rollers do not become flattened during the standstill, but the fibres are still held by the roller pair.

Overall, the drafting system has very good accessibility for thread piecing or for changing rollers and replacing aprons. Only one spinning position has to be stopped and neighbouring spinning positions can continue to run unhindered. Overall, the drafting system is easily visible from the side. The drafting systems are configured in such a way that they can be easily seen from the same side so that they can be checked quickly and easily during inspection rounds around spinning machines.

The housing of the drafting system is the supporting structure in which the individual parts of the drafting system are directly or indirectly mounted or fastened.

In some embodiments, the bottom rollers can each be mounted on a bottom roller carrier fixed in the housing. As a rule, the pivotable top roller carrier can be connected to the bottom roller carrier so that it can pivot about a rotary axis of the top roller carrier. Such a bottom roller carrier can be displaced along the running direction of the fibre band and fixed in a desired position in order to bring the individual bottom rollers into the desired position. Templates of prior art can be used as positioning aids for the rollers.

In some embodiments, the rotary axis of the top roller carrier can be arranged downstream or upstream of the roller pairs in the running direction of the fibre band, so that the top roller carrier can be swung out in the running direction or against the running direction. The roller pairs can therefore be aligned in such a way that the top roller can still be swung out even if the roller pairs are arranged close to one another. The position of the rotary axis and the shape of the top roller carrier can be selected so that the top roller can be moved substantially upwards away from the bottom roller during pivoting out. The roller carrier can have a straight, angled or curved shape. As a rule, it has a contact area for the weighting device which extends parallel to the drafting system plane.

In some embodiments, a top roller axis of the top roller can be mounted at both ends in a top roller yoke attached to the top roller carrier. The top roller axis of the top roller is thus loaded equally on both sides and tilting of the top roller axis is prevented, even when the force applied is asymmetrically to the middle of the roller.

A top roller axis of the top roller can be secured by means of a top roller safety device in the top roller yoke, e.g. in a corresponding groove of the top roller yoke. The top roller safety device can preferably be released by hand. In this way, the top roller can be replaced quickly without the need for tools. The top roller yoke can be attached to the top roller carrier so that it can be displaced along the running direction of the fibre band, so that the top roller can be brought into a desired position relative to the bottom roller and fixed in place. In this way, it is possible to set a so-called upstream protrusion or downstream protrusion of the top roller in relation to the bottom roller. Here, too, templates can be used as positioning aids.

In some embodiments, the weighting device can have a load element, preferably a pneumatic or spring-loaded load element selected, for example, from the group consisting of a pneumatic cylinder, air spring, coil spring, leaf spring, diaphragm cylinder, diaphragm compression element, and bellows. A load element can act on a single roller pairs at a time or on several roller pairs simultaneously.

In some embodiments, the weighting device or load element can be movable and attachable to the weighting arm in various positions along the running direction of the fibre band so that a point of application of the load by the weighting device can be brought into a desired position of the top roller carrier and fixed in place. In this way, the load application can be optimised. Depending on the position, the lever of the top roller carrier is increased or decreased. With each weighting device, the force applied to the top roller can be individually adjusted.

In some embodiments, the weighting device can have a convex load head, in which case the load head can be movable and attachable to the top roller carrier in various positions along the running direction of the fibre band, such that a point of application of the load by the weighting device can be brought into a desired position relative to the top roller carrier and fixed in place. The convex load head can be hemispherical, dome-shaped or mushroom-shaped.

In some embodiments, the weighting arm can be lockable in a closed position without play. For this purpose, a fixed stop is preferably provided in the housing of the weighting arm.

In some embodiments, the weighting device can be movable to a weighting position or a non-weighting position when the weighting arm is in the closed position. The weighting devices of a drafting system can be moved individually or in a group into the weighting position or the non-weighting position.

In some embodiments, the point of application of the load by the weighting device can be offset from the middle of the top roller along the top roller axis. In other words, the point of application of the weighting device can be arranged asymmetrically with respect to the middle of the top roller and offset to the same side along the top roller axis in all roller pairs, so that the visibility and operability of the drafting system from one side is increased. This increases the visibility from the same side and leads to easier and faster control of the drafting system during inspection rounds around the spinning machine.

In the drafting system described, the contact force of the roller pairs can be individually adjusted via the weighting devices, in that, on the one hand, the force of the load elements can be controlled and, on the other hand, the point of application of the weighting device on the top roller carrier can be moved to the desired position in each case.

Furthermore, one or more top and/or bottom rollers can be wrapped with an apron, as already known in the prior art. The respective aprons can be guided by one or more additional guide elements in addition to being guided by the corresponding roller or counter-roller.

Furthermore, the bottom rollers in the drafting system can be cantilevered or mounted on both ends.

BRIEF EXPLANATION OF THE FIGURES

The present invention should be explained in more detail below by means of embodiment examples in connection with the drawing(s). In the drawings.

WAYS TO IMPLEMENT THE PRESENT INVENTION

Figure 1:
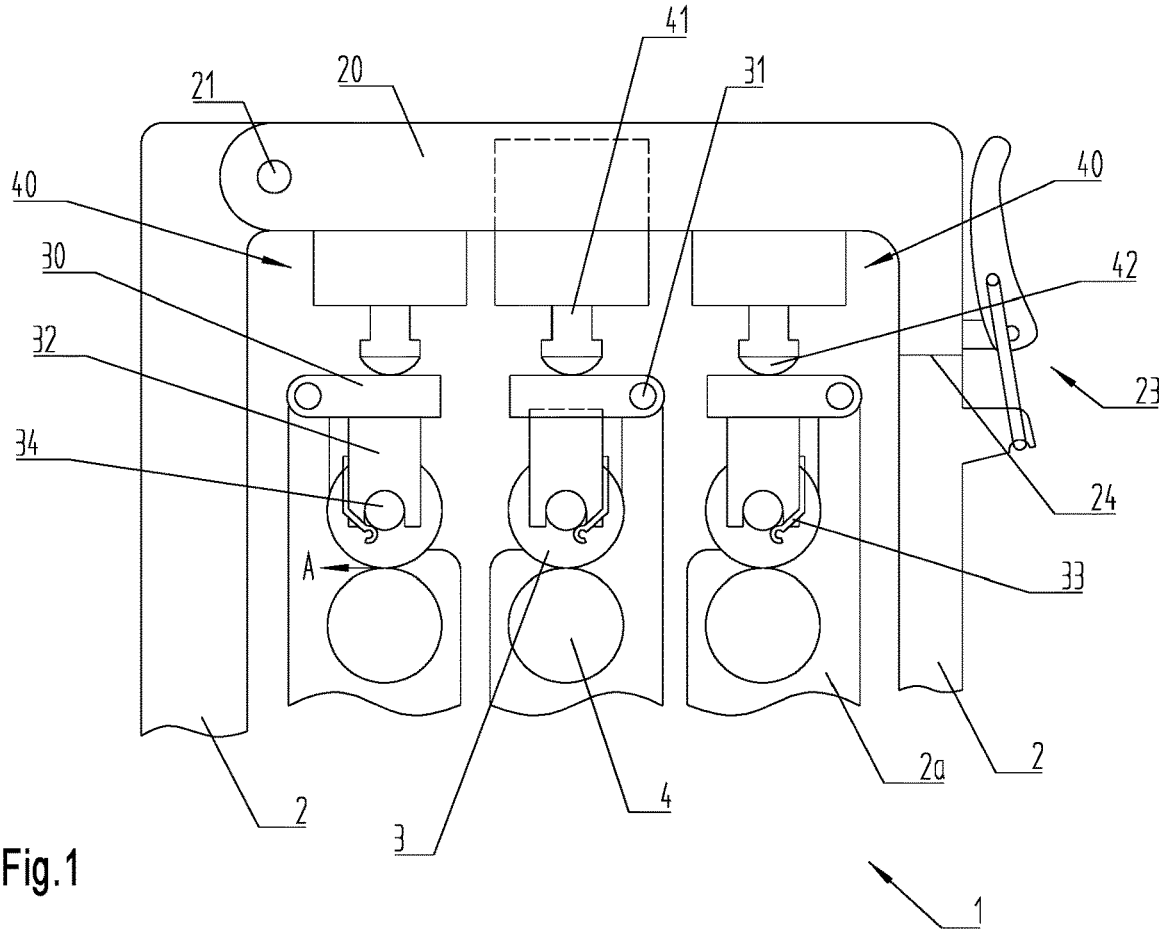
FIG. 1 shows a schematic side view of a drafting system.
Figure 2:
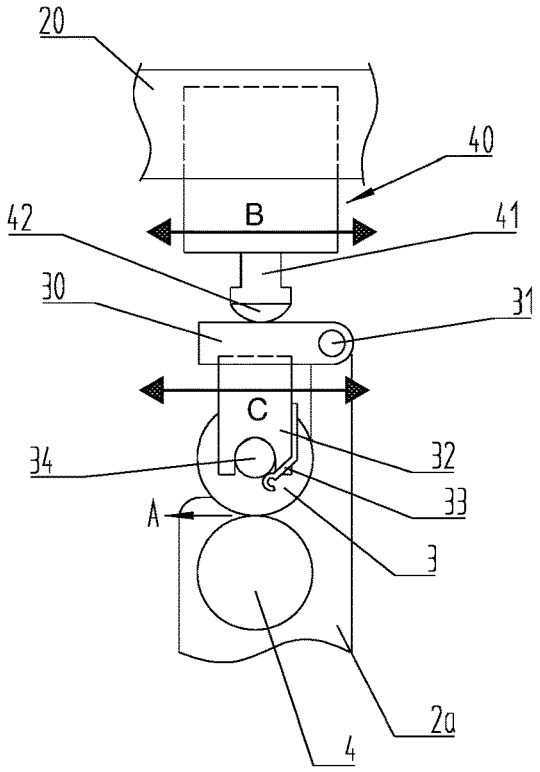
FIG. 2 shows a detail of the drafting system from FIG. 1.

FIG. 1 shows a schematic side view of an embodiment of a drafting system for a textile machine. The drafting system 1 has a plurality of roller pairs and is particularly suitable for an air-spinning machine, in which precise positioning and loading of the roller pairs is essential due to the high spinning speeds. FIG. 2 shows a detail of FIG. 1 with a roller pair.

The drafting system 1 has several roller pairs arranged in succession in a running direction A of a fibre band, each with a top roller 3 and a bottom roller 4. Furthermore, the drafting system can have aprons known from the prior art, which are not shown here. Each bottom roller 4 can be mounted in a manner of prior art on a bearing block or a bottom roller carrier 2*a* in the drafting system housing 2. As a rule, their positioning relative to the running direction A can be adjusted and fixed in place.

Each top roller 3 is attached to a top roller carrier 30 which can be pivoted about a rotary axis 31. The rotary axis 31 runs parallel to the rotary axes of the rollers. The pivotable top roller carrier 30 is connected to the bearing block or bottom roller carrier 2*a* of the bottom roller 4 or the drafting system housing. For the mounting of the top roller 3, the top roller carrier 30 can have a top roller yoke 32, which is connected to the top roller carrier 30. This connection is configured in such a way that the top roller yoke 32 can be moved relative to the top roller carrier 30 in the running direction A of the drafting system and fixed in the desired position. This allows precise positioning of the top roller 3 in relation to the bottom roller 4. In particular, it is possible in this way to adjust an upstream or downstream protrusion of the top roller 3 relative to the bottom roller 4. The displaceability is indicated by arrow C in FIG. 2 and FIG. 4.

The top roller yoke 32 applies a load on the top roller axis 34 on both sides so that an even contact force of the two rollers is achieved.

The rotary axis 31 of the top roller carrier 30 can also be located further down than shown in the figures and closer to the rotary axis of the top roller 3. An angled or curved top roller carrier can also be used instead of the straight top roller carrier 30 shown.

In order to hold the top roller 4 in the mounting of the top roller yoke 32, in particular when the top roller carrier 31 pivots out, a top roller safety device 33, e.g. in the form of a leaf spring, is provided in the embodiment shown, which acts on the top roller axis 34. This can be loosened in a simple manner by hand so that the top roller axis 34 with the top roller 4 can be easily removed from the mounting on the top roller yoke 32. Other embodiments of the top roller safety device 33 are also possible.

A weighting arm 20 is arranged above the top rollers 4, which is pivotably connected to the drafting system housing 2 via a rotary axis 21. The rotary axis 21 also runs parallel to the rotary axes of the rollers. The weighting arm 40 can be moved back and forth between an open position and a closed position. In the closed position, the weighting arm 40 preferably rests against a fixed stop 24 and can be secured in position by means of a locking mechanism 23 so that it assumes a backlash-free and precisely defined position in the closed position.

A weighting device 40 is arranged on the weighting arm 20 for each roller pair. The weighting device 40 is used to apply a load to a top roller 3 in each case. For this purpose, the weighting device 40 has a load element 41 and a convex load head 42. The load element can be configured as a pneumatic or spring-loaded load element (for example, a pneumatic cylinder, air spring, coil spring, leaf spring, diaphragm cylinder, diaphragm pressure element or bellows). The load head 42 provides a precisely positionable point of application of the load by the weighting device 40 to the top roller carrier 30. The load can be finely adjusted by moving the point of application.

In the embodiment shown, the weighting device 40 or the load element 41 is held in the weighting arm 20 so that it can be moved and fixed in a desired position relative to the top roller carrier 30 in the running direction A of the drafting system. With this displaceability, the point of application of the load element 41 relative to the top roller carrier 30 or the top roller 3 can be adjusted in order to achieve fine adjustment of the contact pressure of the top roller 3 on the bottom roller 3 via the lever effect of the top roller carrier 30. The displaceability is indicated by arrow B in FIG. 2.

Figure 3:
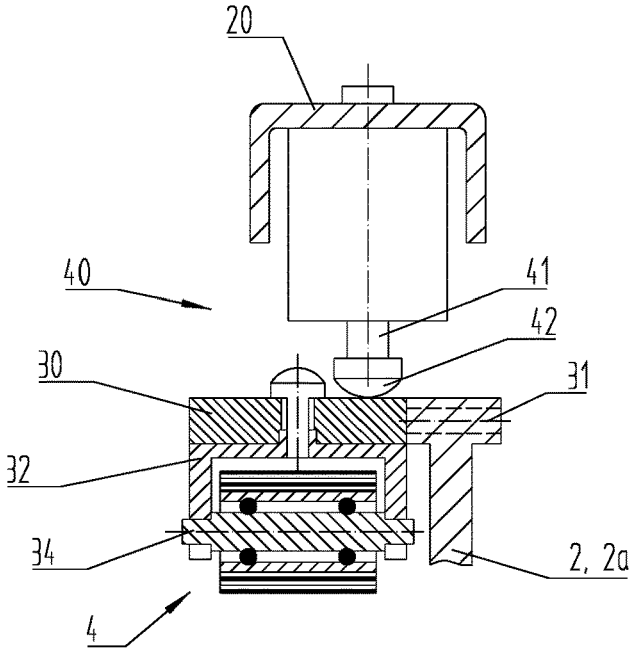
FIG. 3 shows a sectional view of a top roller suspension with weighting device.

FIG. 3 shows a sectional view of a top roller suspension with weighting device 40 as described above. The top roller axis 34 of the top roller 4 is mounted in the top roller yoke 32. The top roller yoke 32 is attached to the top roller carrier 30 so that it can be moved and fixed in place. In the embodiment shown, a protrusion of the top roller yoke 32 is guided in a guide of the top roller carrier 30. The top roller yoke 32 can be fixed with a screw. In the same way, the weighting device 40 can be connected to the weighting arm 20.

The point of application of the load by the weighting device 40 is arranged asymmetrically with respect to the middle of the top roller 3 and offset to the same side along the top roller axis 34 in all roller pairs, so that the visibility and operability of the drafting system from one side is increased.

Figure 4:
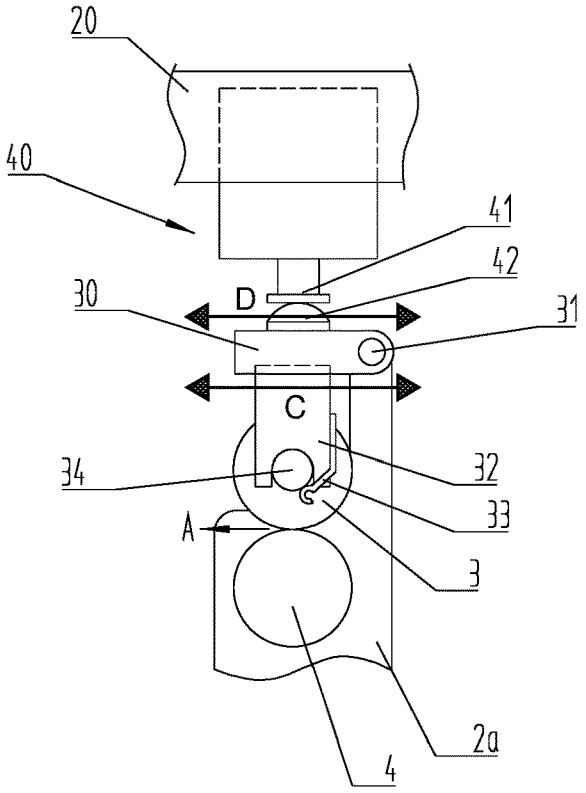
FIG. 4 shows a section of the drafting system with a weighting device with a movable load head.

FIG. 4 shows a section of the drafting system with a further embodiment of a weighting device. In contrast to the weighting device of FIG. 2, the convex load head 42 can be fastened to the top roller carrier 31 in various positions along the running direction A of the drafting system and contacts the load element 41 with the convex side. The fine adjustment described above can be achieved by moving (arrow D) the load head 42. This embodiment has the advantage that when the bottom roller carrier 2*a* is displaced, the point of application of the load by the weighting device 40 is not displaced relative to the top roller carrier 31, and a possible new fine adjustment is not necessary.

Figure 5A:
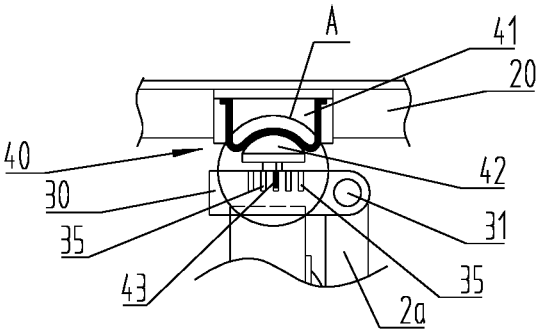
FIG. 5 shows, under (a), a weighting device with movable load head and, under (b), a detailed view from FIG. 5(*a*)
Figure 5B:
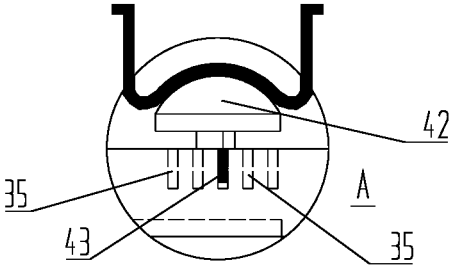

FIG. 5(*a*) shows an embodiment of the weighting device with a diaphragm cylinder as load element 41. Furthermore, a convex load head 42 is shown, which can be attached to the top roller carrier 30 at various positions. FIG. 5(*b*) shows a larger detailed view from FIG. 5(*a*).

Figure 6:
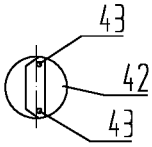
FIG. 6 shows a top view of a load head.

In the variant, the load head 42 has two pins 43 on an underside opposite the convex side, which can be inserted into double bores 35 in the top roller carrier 30. In order to position the load head 42 at different locations, the top roller carrier 30 has a number of evenly spaced double bores 35 (steps). A top view of the underside of the load head is shown in FIG. 6.

The pins 43 are offset ¼ the distance of the double bores 35 from the axis of the load head 42. By inserting the load head 42 alternately rotated 180° into the double bores 35, the number of steps can be doubled in relation to the number of double bores 35. Sloped surfaces can be formed on a base of the load head 42 as a visual check of the orientation of the load head 42.

The convex side of the load head 42 is spherical, dome-shaped or mushroom-shaped, so that a diaphragm of the diaphragm cylinder is entirely without a hard surface. The substructure of the load head or the bottom roller carrier 2*a* can be moved slightly without having to move the diaphragm cylinder as well.

The pins can also be rectangular or oval in shape, so that even with only one pin, independent twisting of the load head 42 is prevented.

To achieve a higher load, the diaphragm cylinder can be oval or elliptical in shape.

Figure 7:
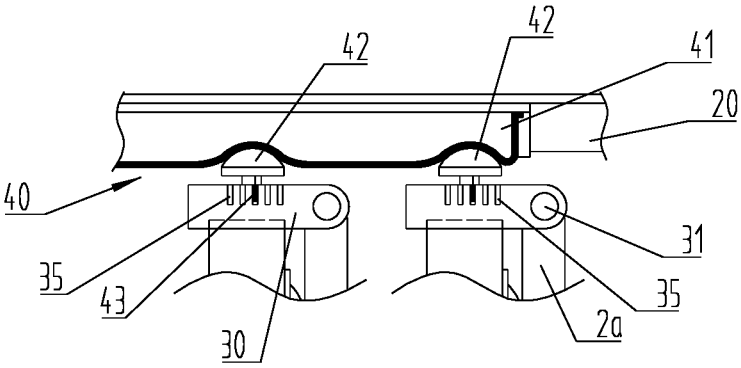
FIG. 7 shows a weighting device with a load element for several roller pairs.

In contrast to FIG. 5, FIG. 7 shows an embodiment of the weighting device 40 with a diaphragm element as load element 41, which extends over several roller pairs. The diaphragm element can be tubular or sausage-shaped and acts on the load head 42 from several roller pairs. In this case, the force application can be individually adjusted via the positioning of the load head 42 relative to the top roller carrier 30.

LIST OF REFERENCE SIGNS

1 Drafting system
2 Housing of the drafting system (supporting structure)
2*a* Bottom roller carrier
3 Top roller
4 Bottom roller
20 Weighting arm
21 Rotary axis weighting arm
23 Locking mechanism of the weighting arm
24 Stop
30 Top roller carrier
31 Rotary axis top roller carrier
32 Top roller yoke
33 Top roller safety device
34 Top roller axis
35 Double bore
40 Weighting device
41 Load element
42 Convex load head
43 Pin
A Fibre running direction
B Mobility of load element
C Mobility of top roller yoke
D Mobility of load head

The invention claimed is:

1. A drafting system (1) for a textile machine for drawing a strand-shaped fibre band fed to the drafting system, comprising:
- a plurality of roller pairs arranged in succession in a running direction (A) of the fibre band, each roller pair of the plurality of roller pairs comprising:
  - a top roller (3);
  - a bottom roller (4); and
  - an individually adjustable weighting device (40) configured to apply a load to the top roller (3) of the plurality of roller pairs
  - wherein:
    - the bottom roller (4) is mounted and held in a housing (2) of the drafting system (1), and
    - the top roller (3) is mounted and held in the housing (2) of the drafting system (1) via a top roller carrier (30) configured to be pivoted about a rotary axis; and
- a swiveling weighting arm (20) configured to be brought into an open position and a closed position,
- wherein:
  - the weighting arm (20) comprises the individually adjustable weighting device (40) for each roller pair of the plurality of roller pairs, configured to apply a load to the pivotable top roller carrier (30) in a weighting position when the weighting arm (20) is closed,
  - the weighting device (40) comprises a convex load head (42), and
  - the load head (42) is capable of being moved and attached to the top roller carrier (30) in various positions along the running direction (A) of the fibre band, such that a point of application of the load by the weighting device is capable of being brought into a desired position relative to the top roller carrier (30) and fixed in place.

2. The drafting system according to claim 1, wherein the bottom rollers (4) are each mounted on a bottom roller carrier (2*a*) fixed in the housing (2).

3. The drafting system according to claim 2, wherein the bottom roller carrier (2*a*) is configured to be:
- displaced along the running direction (A) of the fibre band; and
- fixed in a desired position.

4. The drafting system according to claim 2, wherein the pivotable top roller carrier (30) is connected to the bottom roller carrier (2) such that it can pivot about a rotary axis (31) of the top roller carrier (30).

5. The drafting system according to claim 1, wherein the rotary axis (31) of the top roller carrier (30) is arranged downstream or upstream of the roller pairs in the running direction (A) of the fibre band, such that the top roller carrier (30) can be swung out in the running direction (A) or against the running direction (A).

6. The drafting system according to claim 1, further comprising a top roller axis (31) of the top roller (3), mounted at both ends in a top roller yoke (32) attached to the top roller carrier (30).

7. The drafting system according to claim 6, wherein the top roller axis (31) of the top roller (3) is secured in the top roller yoke (32) via a top roller safety device (33).

8. The drafting system according to claim 6, wherein the top roller yoke (32) is attached to the top roller carrier (30) such that it can be displaced along the running direction (A) of the fibre band, so that the top roller (3) can be brought into a desired position relative to the bottom roller (4) and fixed in place.

9. The drafting system according to claim 1, wherein the weighting device (40) comprises a load element (41) wherein the load element comprises a pneumatic or spring-loaded load element.

10. The drafting system according to claim 9, wherein the weighting device (40) or the load element (41) is configured to be moved and attached to the weighting arm (20) in various positions along the running direction (A) of the fibre band so that a point of application of the load by the weighting device (40) is capable of being brought into a desired position of the top roller carrier (30) and fixed in place.

11. The drafting system according to claim 1, wherein the weighting arm (20) is configured to be locked in a closed position without play.

12. The drafting system according to claim 1, wherein the weighting device (40) is configured to be brought into a weighting position or a non-weighting position when the weighting arm (20) is in the closed position.

13. The drafting system according to claim 1, wherein:

the weighting device (40) comprises one or more weighting devices (40), and the one or more weighting devices (40) are configured to be moved, individually or in a group, into the weighting position or the non-weighting position.

14. The drafting system according to claim 1, wherein a point of application of the load by the weighting device (40) is offset with respect to a middle of the top roller (3) along a top roller axis (34).

15. The drafting system according to claim 7, wherein the top roller safety device (33) is configured to be released by hand.

16. The drafting system according to claim 9, wherein the pneumatic or spring-loaded load element is selected from the group consisting of: a pneumatic cylinder; an air spring; a coil spring; a leaf spring; a diaphragm cylinder; a diaphragm compression element; and a bellows.

17. A drafting system (1) for a textile machine for drawing a strand-shaped fibre band fed to the drafting system, comprising:

a plurality of roller pairs arranged in succession in a running direction (A) of the fibre band, each roller pair of the plurality of roller pairs comprising:

a top roller (3);

a bottom roller (4); and an individually adjustable weighting device (40) configured to apply a load to the top roller (3) of the plurality of roller pairs wherein:

the bottom roller (4) is mounted and held in a housing (2) of the drafting system (1), and the top roller (3) is mounted and held in the housing (2) of the drafting system (1) via a top roller carrier (30) configured to be pivoted about a rotary axis; and a swiveling weighting arm (20) configured to be brought into an open position and a closed position, wherein:

the weighting arm (20) comprises the individually adjustable weighting device (40) for each roller pair of the plurality of roller pairs, configured to apply a load to the pivotable top roller carrier (30) in a weighting position when the weighting arm (20) is closed, the bottom rollers (4) are each mounted on a bottom roller carrier (2*a*) fixed in the housing (2), and the pivotable top roller carrier (30) is connected to the bottom roller carrier (2) such that it can pivot about a rotary axis (31) of the top roller carrier (30).

18. A drafting system (1) for a textile machine for drawing a strand-shaped fibre band fed to the drafting system, comprising:

a plurality of roller pairs arranged in succession in a running direction (A) of the fibre band, each roller pair of the plurality of roller pairs comprising:

a top roller (3);

a bottom roller (4); and an individually adjustable weighting device (40) configured to apply a load to the top roller (3) of the plurality of roller pairs wherein:

the bottom roller (4) is mounted and held in a housing (2) of the drafting system (1), and the top roller (3) is mounted and held in the housing (2) of the drafting system (1) via a top roller carrier (30) configured to be pivoted about a rotary axis;

a top roller axis (31) of the top roller (3), mounted at both ends in a top roller yoke (32) attached to the top roller carrier (30); and a swiveling weighting arm (20) configured to be brought into an open position and a closed position, wherein the weighting arm (20) comprises the individually adjustable weighting device (40) for each roller pair of the plurality of roller pairs, configured to apply a load to the pivotable top roller carrier (30) in a weighting position when the weighting arm (20) is closed.

19. A drafting system (1) for a textile machine for drawing a strand-shaped fibre band fed to the drafting system, comprising:

a plurality of roller pairs arranged in succession in a running direction (A) of the fibre band, each roller pair of the plurality of roller pairs comprising:

a top roller (3);

a bottom roller (4); and an individually adjustable weighting device (40) configured to apply a load to the top roller (3) of the plurality of roller pairs wherein:

the bottom roller (4) is mounted and held in a housing (2) of the drafting system (1), and the top roller (3) is mounted and held in the housing (2) of the drafting system (1) via a top roller carrier (30) configured to be pivoted about a rotary axis; and a swiveling weighting arm (20) configured to be brought into an open position and a closed position, wherein:

the weighting arm (20) comprises the individually adjustable weighting device (40) for each roller pair of the plurality of roller pairs, configured to apply a load to the pivotable top roller carrier (30) in a weighting position when the weighting arm (20) is closed, and the weighting device (40) is configured to be brought into a weighting position or a non-weighting position when the weighting arm (20) is in the closed position.

20. A drafting system (1) for a textile machine for drawing a strand-shaped fibre band fed to the drafting system, comprising:

a plurality of roller pairs arranged in succession in a running direction (A) of the fibre band, each roller pair of the plurality of roller pairs comprising:

a top roller (3);

a bottom roller (4); and an individually adjustable weighting device (40) configured to apply a load to the top roller (3) of the plurality of roller pairs wherein:

the bottom roller (4) is mounted and held in a housing (2) of the drafting system (1), and the top roller (3) is mounted and held in the housing (2) of the drafting system (1) via a top roller carrier (30) configured to be pivoted about a rotary axis; and a swiveling weighting arm (20) configured to be brought into an open position and a closed position, wherein:

the weighting arm (20) comprises the individually adjustable weighting device (40) for each roller pair of the plurality of roller pairs, configured to apply a load to the pivotable top roller carrier (30) in a weighting position when the weighting arm (20) is closed, and a point of application of the load by the weighting device (40) is offset with respect to a middle of the top roller (3) along a top roller axis (34).

* * * * *